US010838314B2

(12) United States Patent
Ikezue et al.

(10) Patent No.: US 10,838,314 B2
(45) Date of Patent: Nov. 17, 2020

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Tatsuya Ikezue, Toride (JP); Kumiko Takizawa, Saitama (JP); Ikuyo Kuroiwa, Tokyo (JP); Kan Tanabe, Matsudo (JP); Tsuyoshi Shimada, Kashiwa (JP); Haruhiko Mitsuda, Nagareyama (JP); Takanori Ueno, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/654,467

(22) Filed: Oct. 16, 2019

(65) Prior Publication Data

US 2020/0133148 A1 Apr. 30, 2020

(30) Foreign Application Priority Data

Oct. 26, 2018 (JP) ..... 2018-202047

(51) Int. Cl.
*G03G 5/14* (2006.01)
*G03G 5/147* (2006.01)
*G03G 5/05* (2006.01)

(52) U.S. Cl.
CPC ..... *G03G 5/144* (2013.01); *G03G 5/056* (2013.01); *G03G 5/0564* (2013.01);
(Continued)

(58) Field of Classification Search
CPC ..... G03G 5/144; G03G 5/056; G03G 5/0564; G03G 5/0503; G03G 5/14752; G03G 5/14756; G03G 5/14726
See application file for complete search history.

(56) References Cited

U.S. PATENT DOCUMENTS 5,198,685 A 3/1993 Kitani et al.
5,393,628 A 2/1995 Ikezue et al.
(Continued)

FOREIGN PATENT DOCUMENTS

JP 2005-031433 2/2005
JP 2006-084941 3/2006
(Continued)

OTHER PUBLICATIONS

Diamond, Arthur S. (ed.) Handbook of Imaging Materials. New York: Marcel-Dekker, Inc. (2001) pp. 145-164.*
(Continued)

*Primary Examiner* — Christopher D Rodee
(74) *Attorney, Agent, or Firm* — Venable LLP

(57) ABSTRACT

The electrophotographic photosensitive member includes an undercoat layer and a surface layer on or above a support in this order, in which the undercoat layer contains metal oxide particles and a specific binder resin, the surface layer contains a charge transporting substance, fluororesin particles, and a specific binder resin, an arithmetic average roughness Ra of a surface of the undercoat layer is 0.15 μm or less, a refractive index (a) of the metal oxide particles and a refractive index (b) of the binder resin contained in the undercoat layer satisfy a specific relationship, and a refractive index (c) of the binder resin contained in the surface layer and a refractive index (d) of the fluororesin particles satisfy a specific relationship.

7 Claims, 2 Drawing Sheets

(52) U.S. Cl.
CPC ..... *G03G 5/14726* (2013.01); *G03G 5/14752* (2013.01); *G03G 5/14756* (2013.01)

(56) References Cited

U.S. PATENT DOCUMENTS 5,485,250 A 1/1996 Kashimura et al.
5,504,558 A 4/1996 Ikezue
5,994,011 A 11/1999 Kashimura
6,156,468 A * 12/2000 Wehelie ..... G03G 5/142 430/65
6,183,922 B1 2/2001 Takai et al.
6,218,063 B1 4/2001 Tanaka et al.
6,335,132 B1 1/2002 Tanaka et al.
6,806,009 B2 10/2004 Tanaka et al.
6,815,135 B2 11/2004 Morikawa et al.
6,835,512 B2 12/2004 Morikawa et al.
6,913,862 B2 7/2005 Nakata et al.
6,998,210 B2 2/2006 Yoshimura et al.
7,022,446 B2 4/2006 Yoshimura et al.
7,078,140 B2 7/2006 Yoshimura et al.
7,186,489 B2 3/2007 Uematsu et al.
7,226,711 B2 6/2007 Amamiya et al.
7,534,534 B2 5/2009 Nakata et al.
7,553,594 B2 6/2009 Ogaki et al.
7,813,675 B2 10/2010 Tanabe et al.
8,524,432 B2 9/2013 Nukada et al.
9,599,917 B2 3/2017 Okuda et al.
9,766,561 B2 9/2017 Takahashi et al.
9,983,490 B2 5/2018 Shimada et al.
10,241,429 B2 3/2019 Shimada et al.
10,338,486 B2 7/2019 Abe et al.
10,353,340 B2 7/2019 Kuroiwa et al.
10,488,770 B2 11/2019 Kuroiwa et al.
2005/0118520 A1* 6/2005 Takeshima ..... G03G 5/144 430/60
2009/0214967 A1* 8/2009 Iwanaga ..... G03G 5/047 430/56
2009/0232552 A1* 9/2009 Mitsumori ..... G03G 5/104 399/159
2018/0307148 A1* 10/2018 Ishida ..... G03G 5/14791
2018/0314188 A1 11/2018 Takeuchi et al.
2019/0072865 A1 3/2019 Ohira et al.
2019/0163078 A1* 5/2019 Anezaki ..... G03G 5/0662
2019/0369513 A1 12/2019 Ueno et al.
2020/0019093 A1 1/2020 Tsuruga et al.

FOREIGN PATENT DOCUMENTS

JP 2006-289946 10/2006
JP 2008-233378 10/2008
JP 2009-104145 5/2009
JP 2010-204136 9/2010
JP 2015-184493 10/2015

OTHER PUBLICATIONS

U.S. Appl. No. 16/597,152, Kumiko Takizawa, filed Oct. 9, 2019.
U.S. Appl. No. 16/601,994, Tsuyoshi Shimada, filed Oct. 15, 2019.
U.S. Appl. No. 16/658,591, Takanori Ueno, filed Oct. 21, 2019.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge including the electrophotographic photosensitive member, and an electrophotographic apparatus including the electrophotographic photosensitive member.

Description of the Related Art

Recently, it has been proposed that in an electrophotographic apparatus, a coherent light such as a laser is used as an exposing unit, in order to provide a fax function, a printer function, and a scanner function as well as a copy function. Further, as image quality is higher, a dot size of exposure light from an exposing unit provided in an electrophotographic apparatus is reduced.

Furthermore, as an electrophotographic photosensitive member of an electrophotographic apparatus, an organic electrophotographic photosensitive member having good coatability and suitable for mass production has been proposed. Hereinafter, the organic electrophotographic photosensitive member is simply referred to as an electrophotographic photosensitive member.

Each layer constituting the electrophotographic photosensitive member is often formed by dip coating, and film thickness unevenness is likely to occur in a coating direction. When such an electrophotographic photosensitive member is mounted on an electrophotographic apparatus using coherent light and outputs an image, a defective image having a strip shape due to film thickness unevenness (hereinafter, referred to as an "interference fringe") may occur on a halftone image.

Further, in order to improve abrasion resistance of the electrophotographic photosensitive member, an electrophotographic photosensitive member having a surface layer to which fluororesin particles are added, has been proposed.

Japanese Patent Application Laid-Open No. 2015-184493 discloses that a surface of a support or an undercoat layer is roughened to suppress unevenness of a halftone image density.

Japanese Patent Application Laid-Open No. 2010-204136 discloses that fluororesin particles and a fluorine-based graft polymer having a fluorinated alkyl group having 1 to 7 carbon atoms are contained in a photosensitive layer surface, thereby improving durability of the photosensitive layer.

SUMMARY OF THE INVENTION

An electrophotographic photosensitive member according to an embodiment of the present invention is an electrophotographic photosensitive member including an undercoat layer and a surface layer on or above a support in this order, in which the undercoat layer contains metal oxide particles and a binder resin, the surface layer contains a charge transporting substance, fluororesin particles, and a binder resin, an arithmetic average roughness Ra of a surface of the undercoat layer is 0.15 μm or less, the binder resin contained in the undercoat layer contains at least one selected from the group consisting of a urethane resin, a polyamide resin, and a melamine-alkyd resin, a refractive index (a) of the metal oxide particles and a refractive index (b) of the binder resin contained in the undercoat layer satisfy the following Equation (1):

$$0.70 \leq (a)-(b) \leq 1.00 \quad \text{Equation (1),}$$

the binder resin contained in the surface layer contains at least one selected from the group consisting of a polycarbonate resin and a polyarylate resin, and a refractive index (c) of the binder resin contained in the surface layer and a refractive index (d) of the fluororesin particles satisfy the following Equation (2):

$$0.20 \leq (c)-(d) \quad \text{Equation (2).}$$

Further features of the present invention will become apparent from the following description of exemplary embodiments with reference to the attached drawings.

DESCRIPTION OF THE EMBODIMENTS

Figure 1:
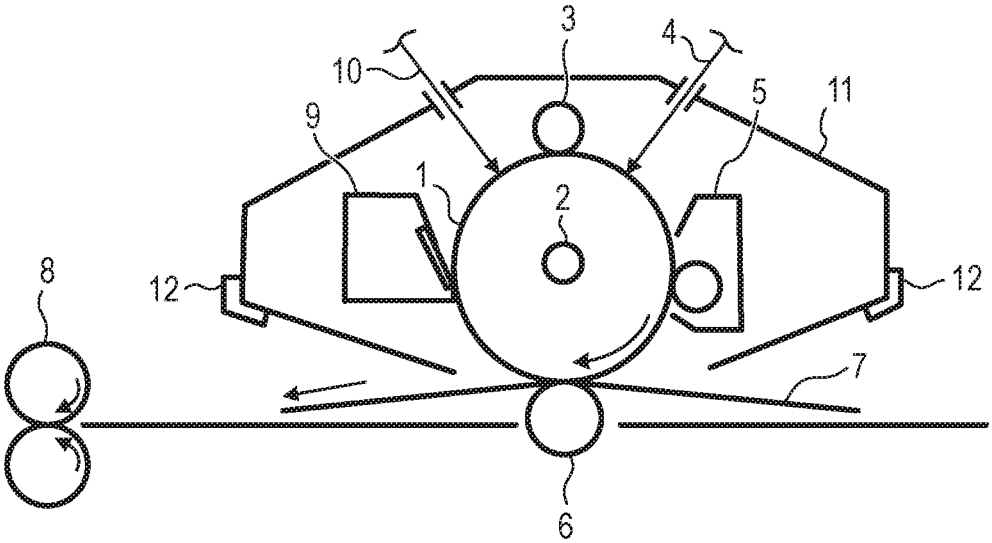
FIG. 1 is a drawing illustrating an example of a schematic configuration of an electrophotographic apparatus provided with a process cartridge having an electrophotographic photosensitive member according to an embodiment of the present invention.

According to the study of the present inventors, when the electrophotographic photosensitive members described in Japanese Patent Application Laid-Open No. 2015-184493 and Japanese Patent Application Laid-Open No. 2010-204136 were used, there were problems in that a defective image having an insufficient halftone image density of a highlight is produced and fine line reproducibility is deteriorated.

Accordingly, an object of the present invention is to provide an electrophotographic photosensitive member which can achieve high reproducibility of the halftone image density of a highlight and good fine line reproducibility, and also high abrasion resistance.

As a result of the study of the present inventors, in the prior art, when a surface layer of the electrophotographic photosensitive member contains fluororesin particles for improving abrasion resistance, extremely small light diffusion was produced from a difference in a refractive index between the fluororesin particles and a binder resin. It was found that when the electrophotographic photosensitive member is irradiated with exposure light having a reduced dot size from a light source, a latent image is disturbed by light scattering, so that reproducibility of the halftone image density of a highlight is deteriorated.

Further, it was found that in the conventional electrophotographic photosensitive member having a roughened undercoat layer surface, light scattering on the roughened undercoat layer surface that is irradiated with exposure light having a reduced dot size from a light source is not able to be ignored, and fine line reproducibility is deteriorated.

Therefore, in order to solve the technical problems which occurred in the prior art, a refractive index difference between the binder resin and the metal oxide particles contained in the undercoat layer and a refractive index difference between the binder resin and the fluororesin particles contained in the surface layer were studied.

As a result, it was found that the electrophotographic photosensitive member can achieve the effect of achieving improvement of abrasion resistance, and also reproducibility of the halftone image density of a highlight and fine line reproducibility, by having the following configuration.

That is, the electrophotographic photosensitive member according to an embodiment of the present invention is an electrophotographic photosensitive member including an undercoat layer and a surface layer on or above a support in this order, in which the undercoat layer contains metal oxide particles and a binder resin, the surface layer contains a charge transporting substance, fluororesin particles, and a binder resin, an arithmetic average roughness Ra of a surface of the undercoat layer is 0.15 μm or less, the binder resin contained in the undercoat layer contains at least one selected from the group consisting of a urethane resin, a polyamide resin, and a melamine-alkyd resin, a refractive index (a) of the metal oxide particles and a refractive index (b) of the binder resin contained in the undercoat layer satisfy the following equation (1):

$$0.70 \leq (a)-(b) \leq 1.00 \quad \text{Equation (1),}$$

the binder resin contained in the surface layer contains at least one selected from the group consisting of a polycarbonate resin and a polyarylate resin, and a refractive index (c) of the binder resin contained in the surface layer and a refractive index (d) of the fluororesin particles satisfy the following equation (2):

$$0.20 \leq (c)-(d) \quad \text{Equation (2).}$$

The present inventors consider the mechanism of solving the problems by the configuration of the electrophotographic photosensitive member according to the embodiment of the present invention as follows.

In the electrophotographic photosensitive member having a roughened undercoat layer surface, exposure light incident on the undercoat layer is diffusely reflected and fine line reproducibility is reduced. In the present invention, a binder resin having high transparency is used in the undercoat layer. Therefore, diffuse reflection on the undercoat layer surface, of the exposure light incident on the undercoat layer is suppressed, and light is transmitted through the undercoat layer. Furthermore, the binder resin and the metal oxide particles contained in the undercoat layer have a constant refractive index difference, and a path of the exposure light incident on the undercoat layer is changed by reflection and refraction. The path of the exposure light is appropriately changed in the undercoat layer and the exposure light is diffused, whereby light returning to the electrophotographic photosensitive member surface is weakened, and as a result, it is considered that even in the case that the undercoat layer surface is roughened, it is possible to achieve both improvement of fine line reproducibility and suppression of an interference fringe.

Further, the surface layer contains the fluororesin particles, whereby the exposure light incident on a boundary surface between the binder resin and the fluororesin particles of the surface layer is refracted and light diffusion occurs. Furthermore, in the undercoat layer, the metal oxide particles have a higher refractive index than the binder resin, while in the surface layer, the binder resin has a higher refractive index than the fluororesin particles. Therefore, in the surface layer and in the undercoat layer, a light refraction direction in the boundary surface between the binder resin and the particle is reversed. That is, it is considered that the change of the light path by light refraction in the boundary surface between the binder resin and the particle is not only in one direction, whereby deviation of light diffused by the fluororesin particles is reduced, and the reproducibility of the halftone image density of a highlight is improved.

As in the above mechanism, it is considered that each configuration produces the effect synergistically, thereby making it possible to achieve the effect of the present invention.

An arithmetic average roughness Ra of the surface of the undercoat layer is 0.15 μm or less, and more preferably 0.10 μm or less. When Ra is 0.15 μm or less, fine line reproducibility is improved.

The arithmetic average roughness Ra of the surface of the undercoat layer can be measured by, for example, a surface roughness measuring instrument. As the surface roughness measuring instrument of the undercoat layer, for example, the following instruments can be used: A surface roughness measuring instrument SURFCORDER SE, 500, 600, and 700 (all manufactured by Kosaka Laboratory Ltd.), SURFCOM NEX, 2800G, 1800G, and 1400G (all manufactured by TOKYO SEIMITSU CO., LTD.), and FORMTRACER SV-C4500 (manufactured by Mitutoyo Corporation).

The binder resin contained in the undercoat layer contains at least one selected from the group consisting of a urethane resin, a polyamide resin, and a melamine-alkyd resin. These resins have high transparency and can transmit exposure light.

A relationship between the refractive index (a) of the metal oxide particles contained in the undercoat layer and the refractive index (b) of the binder resin contained in the undercoat layer satisfy the following Equation (1):

$$0.70 \leq (a)-(b) \leq 1.00 \quad \text{Equation (1).}$$

For the refractive index (a) of the metal oxide particles, various publications, for example, Filler Utilization Dictionary (edited by Filler Society of Japan, Taiseisha Ltd., 1994) can be referred to.

Further, for the refractive index (b) of the binder resin, various publications, for example, Forefront of Refractive Index Control Technology of Optical Materials (CMC Publishing Co., Ltd., 2009) can be referred to.

When the undercoat layer contains plural kinds of metal oxide particles, the refractive index (a) of the metal oxide particles in the present invention is defined as follows.

For each of the n kinds of metal oxide particles, a content (mass) in the undercoat layer is $Wm_i$, a density is $Gm_i$, a refractive index is $Nm_i$, and the refractive index (a) of the metal oxide particles is a value derived from the following Equation (A):

$$(a) = \sum_{i=1}^{n} (Wm_i \times Gm_i \times Nm_i) \Big/ \sum_{i=1}^{n} (Wm_i \times Gm_i) \quad \text{Equation (A)}$$

When (a)−(b) is 0.70 or more, a degree of path change of exposure light is sufficiently high, and occurrence of an interference fringe image can be suppressed. Furthermore, even when a value of (c)−(d) in the following Equation (2)

is large, an image density of halftone of a highlight can be prevented from being thinned. When (a)−(b) is 1.00 or less, a degree of path change of exposure light is not increased too much, and fine line reproducibility can be maintained.

The binder resin contained in the surface layer contains at least one selected from the group consisting of a polycarbonate resin and a polyarylate resin, and the refractive index (c) of the binder resin contained in the surface layer and the refractive index (d) of the fluororesin particles satisfy the following Equation (2):

$$0.20 \leq (c)-(d) \quad \text{Equation (2)}$$

For the refractive index (d) of the fluororesin particles, various publications, for example, Filler Utilization Dictionary (edited by Filler Society of Japan, Taiseisha Ltd., 1994) can be referred to.

Further, for the refractive index (c) of the binder resin, various publications, for example, Forefront of Refractive Index Control Technology of Optical Materials (CMC Publishing Co., Ltd., 2009) can be referred to.

When the surface layer contains plural kinds of fluororesin particles, the refractive index (d) of the fluororesin particles in the present invention is defined as follows, as in the case of the metal oxide particle (a). For each of the n kinds of fluororesin particles, a content (mass) in the surface layer is $Wf_i$, a density is $Gf_i$, a refractive index is $Nf_i$, and the refractive index (d) of the fluororesin particles is a value derived from the following Equation (B):

$$(d)=\Sigma_{i=1}^{n}(Wf_i \times Gf_i \times Nf_i)/\Sigma_{i=1}^{n}(Wf_i \times Gf_i) \quad \text{Equation (B)}$$

When (c)−(d) is 0.20 or more, a degree of path change of exposure light returning from the undercoat layer to the surface layer is not increased too much, and fine line reproducibility can be maintained.

It is preferred that a content of the metal oxide particles in the undercoat layer is 100% by mass or more and 500% by mass or less relative to the binder resin contained in the undercoat layer. When the content of the metal oxide particles in the undercoat layer is 100% by mass or more relative to the binder resin contained in the undercoat layer, a degree of path change of exposure light is increased and generation of an interference fringe image can be suppressed. Further, when the content of the metal oxide particles in the undercoat layer is 500% by mass or less relative to the binder resin contained in the undercoat layer, generation of cracks in the undercoat layer surface can be suppressed, and film peeling can be avoided.

The fluororesin particles contained in the surface layer are preferably tetrafluoroethylene resin particles.

As long as the refractive index (c) of the binder resin and the refractive index (d) of the fluororesin particles satisfy Equation (2), the fluororesin particles may include one or two or more of fluororesin particles other than the tetrafluoroethylene resin particles. Examples of the fluororesin particles include a trifluoroethylene chloride resin, a hexafluoropropylene resin, a vinyl fluoride resin, a vinylidene fluoride resin, a difluorodichloroethylene resin, and copolymers thereof.

It is preferred that a content of the fluororesin particles in the surface layer is 3.0% by mass or more and 20.0% by mass or less relative to the total mass of the surface layer.

When the content of the fluororesin particles in the surface layer is 3.0% by mass or more relative to the total mass of the surface layer, the effect of abrasion resistance can be highly obtained. Further, when the content of the fluororesin particles in the surface layer is 20.0% by mass or less relative to the total mass of the surface layer, reproducibility of the halftone image density of a highlight is increased.

The surface layer may further contain, for example, an abrasion resistance improver such as polystyrene resin particles, polyethylene resin particles, silica particles, alumina particles, and boron nitride particles.

A number average primary particle diameter of the abrasion resistance improver is preferably 100 nm or more and 1000 nm or less, and more preferably 100 nm or more and 500 nm or less.

In an any region including at least a part of each of the surface layer and the undercoat layer of a cut surface obtained by cutting the electrophotographic photosensitive member vertically from the surface layer toward the undercoat layer, when a ratio of a cross-sectional area of the metal oxide particles contained in the undercoat layer to a cross-sectional area of the undercoat layer is e %, and a ratio of a cross-sectional area of the fluororesin particles contained in the surface layer to a cross-sectional area of the surface layer is f %, it is preferred that e and f satisfy the following Equation (3):

$$5.0 \leq e/f \leq 15.0 \quad \text{Equation (3)}$$

When e/f is 5.0 or more, the halftone image density of a highlight is increased, and even when the content of the metal oxide particles in the undercoat layer is decreased, generation of an interference fringe image can be suppressed. Further, when e/f is 15.0 or less, fine line reproducibility is excellent.

The e and f values can be determined by cutting a vicinity of an axial center of the electrophotographic photosensitive member into a round slice to cut out a cross section, which is mounted to a device such as a microscope to obtain an image, and then analyzing the obtained image. Examples of the microscope include a laser microscope, a confocal microscope, a white interference microscope, a digital holographic microscope, a microscope in which three methods of a confocal method, an interference method, and a focal point transfer method can be used together, and the like.

As the laser microscope, for example, the following instruments can be used: a shape analysis laser microscope, VK-X1000 (manufactured by KEYENCE CORPORATION); a 3D measurement laser microscope OLS5000 (manufactured by Olympus Corporation); and a laser microscope OPTELICS HYBRID (manufactured by Lasertec Corporation).

As the confocal microscope, for example, a hybrid LED confocal microscope ZEISS Smartproof 5 (manufactured by Carl Zeiss Microscopy) can be used.

As the white interference laser microscope, for example, the following instruments can be used: a surface shape measurement system Surface Explorer SX-520DR type machine (manufactured by Ryoka Systems Inc.); a scanning white interference microscope VS-1500 series and VS-1330 (both manufactured by Hitachi High-Technologies Corporation); an optical interference microscope system BW-5500 series and BW-D500 series (manufactured by Nikon Instech Co., Ltd.); a three-dimensional optical profiler ZYGO NewView series (manufactured by AMETEK. Inc.); a Profilm3D three-dimensional surface shape measurement system (manufactured by Filmetrics Japan, Inc.); and a surface shape measurement device SP-700/500 series (manufactured by TORAY ENGINEERING Co., Ltd.).

As the digital holographic microscope, for example, the following instruments can be used: a one-shot 3D measuring microscope (manufactured by Quantum Design Japan); and a real-time three-dimensional measuring instrument AxiZR3D (manufactured by USHIO INC.)

As the microscope in which three methods of a confocal method, an interference method, and a focal point transfer method are can be used together, for example, a compact 3D shape measuring device sensofar Slynx Snex (manufactured by Japan Laser Corp.) can be used.

It is preferred that the number average primary particle diameter of the metal oxide particles is 10 nm or more and 100 nm or less. When the number average primary particle diameter of the metal oxide particles is 10 nm or more, good dispersibility can be obtained and leakage can be suppressed. When the number average primary particle diameter of the metal oxide particles is 100 nm or less, the metal oxide particles contained in the undercoat layer are not decreased too much, a degree of path change of exposure light is increased to some extent, and generation of an interference fringe image can be suppressed.

It is preferred that the metal oxide particles are strontium titanate or anatase type titanium oxide. When the metal oxide particles are strontium titanate or anatase type titanium oxide, the binder resin contained in the undercoat layer and the metal oxide particles can satisfy the relationship of the above Equation (1).

Subsequently, the configuration of the electrophotographic photosensitive member according to the embodiment of the present invention will be described in detail below.

[Electrophotographic Photosensitive Member]

The electrophotographic photosensitive member according to the embodiment of the present invention includes an undercoat layer and a surface layer on or above a support in this order.

Examples of the method of producing the electrophotographic photosensitive member include a method including preparing a coating solution for each layer described later, applying the coating solution in a desired order of layers, and drying the coated solution. At this time, examples of the method of applying the coating solution include dip coating, spray coating, inkjet coating, roll coating, die coating, blade coating, curtain coating, wire bar coating, ring coating, and the like. Among these, dip coating is preferred from a viewpoint of efficiency and productivity.

<Support>

In the present invention, the electrophotographic photosensitive member includes a support. In the present invention, it is preferred that the support is an electroconductive support having conductivity. Further, examples of a shape of the support include a cylindrical shape, a belt shape, a sheet shape, and the like. Among these, a cylindrical support is preferred. Further, a surface of the support may be subjected to electrochemical processing such as positive electrode oxidation, blast processing, cutting processing, and the like.

A material of the support is preferably metal, resin, glass, and the like.

Examples of the metal include aluminum, iron, nickel, copper, gold, stainless steel, an alloy thereof, and the like. Among these, an aluminum support is preferred.

Further, conductivity may be imparted to a resin or glass by processing such as mixing or coating with an electroconductive material.

<Electroconductive Layer>

In the present invention, an electroconductive layer can be provided on the support. By providing the electroconductive layer, scratches and irregularities on the surface of the support can be concealed, and the reflection of light on the support surface can be controlled.

It is preferred that the electroconductive layer contains conductive particles and a resin.

Examples of the conductive particles include metal oxides, metal, carbon black, and the like. Examples of the metal oxide include zinc oxide, aluminum oxide, indium oxide, silicon oxide, zirconium oxide, tin oxide, titanium oxide, magnesium oxide, antimony oxide, bismuth oxide, and the like. Examples of the metal include aluminum, nickel, iron, nichrome, copper, zinc, silver, and the like.

Among these, it is preferred to use the metal oxide as the conductive particles, and particularly, it is more preferred to use titanium oxide, tin oxide, or zinc oxide.

When the metal oxide is used as the conductive particles, a surface of the metal oxide can be treated with a silane coupling agent, or the metal oxide may be doped with an element such as phosphorus or aluminum or an oxide thereof.

Further, the conductive particle may have a laminate configuration including core material particles and a coating layer which covers the particles. Examples of the core material particles include titanium oxide, barium sulfate, zinc oxide, and the like. Examples of the coating layer include metal oxides such as tin oxide.

Further, when the metal oxide is used as the conductive particles, a volume average particle diameter thereof is preferably 1 nm or more and 500 nm or less, and more preferably 3 nm or more and 400 nm or less.

Examples of the resin include a polyester resin, a polycarbonate resin, a polyvinyl acetal resin, an acryl resin, a silicone resin, an epoxy resin, a melamine resin, a polyurethane resin, a phenol resin, an alkyd resin, and the like.

Further, the electroconductive layer may further contain a masking agent such as silicone oil, resin particles, and titanium oxide, and the like.

An average film thickness of the electroconductive layer is preferably 1 μm or more and 50 μm or less, and particularly preferably 3 μm or more and 40 μm or less.

The electroconductive layer can be formed by preparing a coating solution for an electroconductive layer containing each of the above-described materials and solvents, forming a coating film, and drying the coating film. Examples of the solvent used for the coating solution include alcohol-based solvents, sulfoxide-based solvents, ketone-based solvents, ether-based solvents, ester-based solvents, aromatic hydrocarbon-based solvents, and the like. Examples of a dispersion method for dispersing the conductive particles in the coating solution for an electroconductive layer include a method of using a paint shaker, a sand mill, a ball mill, and a liquid collision type high-speed disperser.

<Undercoat Layer>

In the present invention, an undercoat layer can be provided on the support or the electroconductive layer.

The undercoat layer contains the metal oxide particles and the binder resin.

The binder resin contained in the undercoat layer contains at least one selected from the group consisting of a urethane resin, a polyamide resin, and a melamine-alkyd resin. Further, the binder resin may further contain a resin shown below, as long as the refractive index satisfies the relationship of Equation (1) with the metal oxide particles contained in the undercoat layer:

a polyester resin, a polycarbonate resin, a polyvinylacetal resin, an acryl resin, an epoxy resin, a melamine resin, a phenol resin, a polyvinyl phenol resin, an alkyd resin, a polyvinyl alcohol resin, a polyethylene oxide resin, a polypropylene oxide resin, a polyamic acid resin, a polyimide resin, a polyamideimide resin, a cellulose resin, and the like.

The undercoat layer may be formed as a cured film by polymerizing a composition containing a monomer having a polymerizable functional group. Examples of the polymerizable functional group contained in a monomer having a polymerizable functional group include an isocyanate group, a block isocyanate group, a methylol group, an alkylated methylol group, an epoxy group, a metal alkoxide group, a hydroxyl group, an amino group, a carboxyl group, a thiol group, a carboxylic anhydride group, a carbon-carbon double bond group, and the like.

The relationship between the refractive index (a) of the metal oxide particles and the refractive index (b) of the binder resin contained in the undercoat layer satisfies the following Equation (1):

$$0.70 \leq (a)-(b) \leq 1.00 \qquad \text{Equation (1).}$$

The metal oxide particles are preferably strontium titanate or anatase type titanium oxide.

Further, the undercoat layer may contain particles of indium tin oxide, tin oxide, indium oxide, titanium oxide, zinc oxide, aluminum oxide, silicon dioxide, and the like, as long as the above Equation (1) is satisfied.

Furthermore, the undercoat layer may further contain an electron transporting substance, an electroconductive polymer, and the like, for the purpose of improving electrical properties. In particular, it is preferred that the undercoat layer contains an electron transporting substance.

Examples of the electron transporting substance include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, boron-containing compounds, and the like. An electron transporting substance having a polymerizable functional group may be used as the electron transporting substance and polymerized with the above-described monomer having a polymerizable functional group, thereby forming the undercoat layer as cured film.

Further, the undercoat layer may further contain an additive.

An average film thickness of the undercoat layer is preferably 0.1 μm or more and 50 μm or less, more preferably 0.2 μm or more and 40 μm or less, and particularly preferably 0.3 μm or more and 30 μm or less.

The undercoat layer can be formed by preparing a coating solution for an undercoat layer containing each of the above-described materials and solvent, forming a coating film, and drying and/or curing the coating film. Examples of the solvent used for the coating solution include alcohol-based solvents, ketone-based solvents, ether-based solvents, ester-based solvents, aromatic hydrocarbon-based solvents, and the like.

<Photosensitive Layer>

A photosensitive layer of the electrophotographic photosensitive member is mainly classified into (1) a laminate type photosensitive layer and (2) a single layer type photosensitive layer. (1) The laminate type photosensitive layer includes a charge generation layer containing a charge generating substance and a charge transport layer containing a charge transporting substance. When the electrophotographic photosensitive member does not have a protection layer described later on the photosensitive layer, the charge transport layer is the surface layer in the laminate type photosensitive layer. (2) The single layer type photosensitive layer includes a photosensitive layer containing both the charge generating substance and the charge transporting substance. When the electrophotographic photosensitive member does not have a protection layer described later on the photosensitive layer, the photosensitive layer is the surface layer in the single layer type photosensitive layer.

(1) Laminate Type Photosensitive Layer

The laminate type photosensitive layer includes the charge generation layer and the charge transport layer.

(1-1) Charge Generation Layer

It is preferred that the charge generation layer contains a charge generating substance and a resin.

Examples of the charge generating substance include azo pigments, perylene pigments, polycyclic quinone pigments, indigo pigments, phthalocyanine pigments, and the like. Among these, azo pigments and phthalocyanine pigments are preferred. Among the phthalocyanine pigments, an oxytitanium phthalocyanine pigment, a chlorogallium phthalocyanine pigment, and a hydroxygallium phthalocyanine pigment are preferred.

A content of the charge generating substance in the charge generation layer is preferably 40% by mass or more and 85% by mass or less, and more preferably 60% by mass or more and 80% by mass or less, relative to the total mass of the charge generation layer.

Examples of the resin include a polyester resin, a polycarbonate resin, a polyvinyl acetal resin, a polyvinyl butyral resin, an acryl resin, a silicone resin, an epoxy resin, a melamine resin, a polyurethane resin, a phenol resin, a polyvinyl alcohol resin, a cellulose resin, a polystyrene resin, a polyvinyl acetate resin, a polyvinyl chloride resin, and the like. Among these, a polyvinyl butyral resin is more preferred.

Further, the charge generation layer may further contain an additive such as an antioxidant and an ultraviolet absorber. Specifically, examples thereof include hindered phenol compounds, hindered amine compounds, sulfur compounds, phosphorus compounds, benzophenone compounds, and the like.

An average film thickness of the charge generation layer is preferably 0.1 or more and 1 μm or less, and particularly preferably 0.15 μm or more and 0.4 μm or less.

The charge generation layer can be formed by preparing a coating solution for a charge generation layer containing each of the above-described materials and solvent, forming a coating film, and drying the coating film. Examples of the solvent used for the coating solution include alcohol-based solvents, sulfoxide-based solvents, ketone-based solvents, ether-based solvents, ester-based solvents, aromatic hydrocarbon-based solvents, and the like.

(1-2) Charge Transport Layer

The charge transport layer contains the charge transporting substance and the binder resin. When the charge transport layer is the surface layer in the present invention, the charge transport layer contains the charge transporting substance, the binder resin, and the fluororesin particles.

Examples of the charge transporting substance include polycyclic aromatic compounds, heterocyclic compounds, hydrazone compounds, styryl compounds, enamine compounds, benzidine compounds, triarylamine compounds, resins having a group derived from the substances, and the like. Among these, triarylamine compounds and benzidine compounds are preferred.

A content of the charge transporting substance in the charge transport layer is preferably 25% by mass or more and 70% by mass or less, and more preferably 30% by mass or more and 55% by mass or less, relative to the total mass of the charge transport layer.

Examples of the binder resin include a polyester resin, a polycarbonate resin, an acryl resin, a polystyrene resin, and the like. Among these, a polycarbonate resin and a polyester resin are preferred. The polyester resin is particularly preferably a polyarylate resin.

When the charge transport layer is the surface layer, the binder resin contains at least one selected from the group consisting of a polycarbonate resin and a polyarylate resin. Further, as long as the refractive index (c) of the binder resin and the refractive index (d) of the fluororesin particles satisfy the above Equation (2), the binder resin may contain a polyester resin, an acryl resin, a polystyrene resin, and the like.

A content ratio (mass ratio) between the charge transporting substance and the resin is preferably 4:10 to 20:10, and more preferably 5:10 to 12:10.

Further, the charge transport layer may contain an additive such as an antioxidant, an ultraviolet absorber, a plasticizer, a levelling agent, and a sliding property imparting agent. Specific examples of the additive include hindered phenol compounds, hindered amine compounds, sulfur compounds, phosphorus compounds, benzophenone compounds, siloxane modified resin, silicone oil, and the like.

An average film thickness of the charge transport layer is preferably 5 or more and 50 μm or less, more preferably 8 μm or more and 40 μm or less, and particularly preferably 10 μm or more and 30 μm or less.

The charge transport layer can be formed by preparing a coating solution for a charge transport layer containing each of the above-described materials and solvent, forming a coating film thereof, and drying the coating film. Examples of the solvent used for the coating solution include alcohol-based solvents, ketone-based solvents, ether-based solvents, ester-based solvents, and aromatic hydrocarbon-based solvents. Among these solvents, ether-based solvents or aromatic hydrocarbon solvents are preferred.

(2) Single Layer Type Photosensitive Layer

The single layer type photosensitive layer can be formed by preparing a coating solution for a photosensitive layer containing the charge generating substance, the charge transporting substance, the binder resin, and the solvent, forming a coating film thereof, and drying the coating film. When the single layer type photosensitive layer is the surface layer in the present invention, the coating solution for a photosensitive layer further contains fluororesin particles. Examples of the charge generating substance, the charge transporting substance, and the binder resin are as exemplified in the above "(1) Laminate type photosensitive layer".

<Protection Layer>

In the present invention, a protection layer may be provided on the photosensitive layer. When the protection layer is provided, durability can be improved. When the electrophotographic photosensitive member includes the protection layer, the protection layer is the surface layer in the present invention.

The protection layer contains the charge transporting substance, the fluororesin particles, and the binder resin. The protection layer may further contain conductive particles.

Examples of the conductive particles include particles of metal oxides such as titanium oxide, zinc oxide, tin oxide, and indium oxide.

Examples of the charge transporting substance include polycyclic aromatic compounds, heterocyclic compounds, hydrazone compounds, styryl compounds, enamine compounds, benzidine compounds, triarylamine compounds, resins having a group derived from the substances, and the like. Among these, triarylamine compounds and benzidine compounds are preferred.

The binder resin contains at least one selected from the group consisting of a polycarbonate resin and a polyarylate resin. Further, as long as the refractive index (c) of the binder resin and the refractive index (d) of the fluororesin particles satisfy the above Equation (2), the binder resin may contain other resins exemplified below.

A polyester resin, an acryl resin, a phenoxy resin, a polystyrene resin, a phenol resin, a melamine resin, an epoxy resin, and the like may be contained.

Further, the protection layer may be formed as a cured film by polymerizing a composition containing a monomer having a polymerizable functional group. Examples of the reaction at that time include a thermal polymerization reaction, a photopolymerization reaction, a radiation polymerization reaction, and the like. Examples of the polymerizable functional group of the monomer having the polymerizable functional group include an acryl group, a methacryl group, and the like. As the monomer having the polymerizable functional group, a material having a charge transporting ability may be used.

The protection layer may contain an additive such as an antioxidant, an ultraviolet absorber, a plasticizer, a levelling agent, a sliding property imparting agent, and an abrasion resistance improver. Specific examples of the additive include hindered phenol compounds, hindered amine compounds, sulfur compounds, phosphorus compounds, benzophenone compounds, siloxane modified resin, silicone oil, fluororesin particles, polystyrene resin particles, polyethylene resin particles, silica particles, alumina particles, boron nitride particles, and the like.

An average film thickness of the protection layer is preferably 0.5 μm or more and 10 μm or less, and particularly preferably 1 μm or more and 7 μm or less.

The protection layer can be formed by preparing a coating solution for a protection layer containing each of the above-described materials and solvent, forming a coating film, and drying and/or curing the coating film. Examples of the solvent used for the coating solution include alcohol-based solvents, ketone-based solvents, ether-based solvents, sulfoxide-based solvents, ester-based solvents, aromatic hydrocarbon-based solvents, and the like.

[Process Cartridge and Electrophotographic Apparatus]

A process cartridge according to another embodiment of the present invention integrally support the electrophotographic photosensitive member and at least one unit selected from the group consisting of a charging unit, a developing unit, a transfer unit, and a cleaning unit, and is detachably attachable to a main body of the electrophotographic apparatus.

Further, an electrophotographic apparatus according to still another embodiment of the present invention includes the electrophotographic photosensitive member, a charging unit, an exposing unit, a developing unit, and a transfer unit.

FIG. 1 illustrates an example of a schematic configuration of the electrophotographic apparatus including a process cartridge provided with the electrophotographic photosensitive member according to the embodiment of the present invention.

Reference number 1 is a cylindrical electrophotographic photosensitive member, and rotationally driven at a predetermined circumferential speed in an arrow direction around an axis 2. A surface of the electrophotographic photosensitive member 1 is charged to a predetermined positive or negative potential by a charging unit 3. In addition, in the drawing, a roll charging method by a roll type charging member is illustrated, but a charging method such as a corona charging method, a proximity charging method, or an injection charging method can be adopted. The surface of the charged electrophotographic photosensitive member 1 is irradiated with exposure light 4 from an exposing unit (not illustrated), and an electrostatic latent image corresponding to image information to be desired is formed. The electrostatic latent image formed on the surface of the electrophotographic photosensitive member 1 is developed with a toner contained in a developing unit 5, and on the surface of the electrophotographic photosensitive member 1 a toner image is formed. The toner image formed on the surface of the electrophotographic photosensitive member 1 is transferred to a transfer material 7 by a transfer unit 6. The transfer material 7 to which the toner image has been transferred is conveyed to a fixing unit 8, is subjected to fixing processing of the toner image, and is printed out of the electrophotographic apparatus. The electrophotographic apparatus may include a cleaning unit 9 for removing attached materials such as a toner remaining on the surface of the electrophotographic photosensitive member 1 after transfer. Further, a so-called cleanerless system in which the attached materials are removed by the developing unit 5 or the like without providing the cleaning unit 9 may be used. The electrophotographic apparatus may include an antistatic mechanism for antistatic treatment of the surface of the electrophotographic photosensitive member 1 by exposure light 10 from the exposing unit (not illustrated). Further, in order to attach/detach a process cartridge 11 of the present invention to/from the electrophotographic apparatus, a guide unit 12 such as a rail may be provided.

The electrophotographic photosensitive member of the present invention can be used in a laser beam printer, an LED printer, a copier, a facsimile, a multifunction machine thereof, and the like.

According to the present invention, an electrophotographic photosensitive member achieving reproducibility of a high halftone image density of a highlight and good fine line reproducibility, and also high abrasion resistance is provided.

EXAMPLES

Hereinafter, the present invention will be described in more detail using the Examples and the Comparative Examples. The present invention is not limited at all by the following Examples, without departing from the gist of the invention. In addition, in the description of the following Examples, "parts" are based on mass, unless otherwise specified.

[Method of Producing Strontium Titanate Particles]

Preparation Example of Particles S-1

Hydrous titanium oxide slurry obtained by hydrolyzing an aqueous titanyl sulfate solution was washed with an aqueous alkaline solution.

Next, hydrochloric acid was added to the hydrous titanium oxide slurry to adjust a pH to 0.7, thereby obtaining a titania sol dispersion.

A 1.1-fold molar amount of an aqueous strontium chloride solution was added to 2.2 mol (in terms of titanium oxide) of the titania sol dispersion, the mixture was placed in a reaction vessel, and nitrogen gas replacement was performed.

Furthermore, pure water was added so as to be 1.1 mol/L in terms of titanium oxide.

Next, after mixing with stirring and heating to 90° C., 440 mL of a 10 N aqueous sodium hydroxide solution was added over 15 minutes while applying ultrasonic vibration, and thereafter, reaction was performed for 20 minutes.

Pure water at 5° C. was added to the slurry after the reaction and the solution was rapidly cooled to 30° C. or lower, and then a supernatant was removed.

Furthermore, an aqueous hydrochloric acid solution at pH 5.0 was added to the slurry and stirred for 1 hour, and the solution was washed with pure water repeatedly. Furthermore, the solution was neutralized with sodium hydroxide, filtered with a Nutsche filter, and washed with pure water. The resulting cake was dried to obtain particles S-1.

Preparation Example of Particles S-2

A 1.2-fold molar amount of an aqueous strontium chloride solution was added to 1.6 mol (in terms of titanium oxide) of the titania sol dispersion, the mixture was placed in a reaction vessel, and nitrogen gas replacement was performed. Furthermore, pure water was added so that a titanium oxide concentration was 0.8 mol/L.

Next, after mixing with stirring and heating to 80° C., 950 mL of a 4 N aqueous sodium hydroxide solution was added over 40 minutes while applying ultrasonic vibration, and thereafter, reaction was performed for 20 minutes. The slurry after the reaction was cooled to 30° C. or lower, and then a supernatant was removed. Furthermore, an aqueous hydrochloric acid solution at pH 5.0 was added to the slurry and stirred for 1 hour, and the solution was washed with pure water repeatedly. The resulting cake was dried to obtain particles S-2.

Preparation Example of Particles S-3

A 1.2-fold molar amount of an aqueous strontium chloride solution was added to 0.6 mol (in terms of titanium oxide) of the titania sol dispersion, the mixture was placed in a reaction vessel, and nitrogen gas replacement was performed. Furthermore, after adding 0.05 mol of aluminum sulfate, pure water was added so that a titanium oxide concentration was 0.3 mol/L.

Next, after mixing with stirring and heating to 80° C., 450 mL of a 2 N aqueous sodium hydroxide solution was added over 5 minutes while applying ultrasonic vibration, and thereafter, reaction was performed for 20 minutes. Pure water at 5° C. was added to the slurry after the reaction and the solution was rapidly cooled to 30° C. or lower, and then a supernatant was removed. Furthermore, the slurry was washed with pure water, and the resulting cake was dried to obtain particles S-3.

Preparation Example of Particles S-4

A 1.2-fold molar amount of an aqueous strontium chloride solution was added to 0.6 mol (in terms of titanium oxide) of the titania sol dispersion, the mixture was placed in a reaction vessel, and nitrogen gas replacement was performed. Furthermore, after adding 0.05 mol of aluminum sulfate, pure water was added so that a titanium oxide concentration was 1.3 mol/L.

Next, after mixing with stirring and heating to 80° C., 450 mL of a 2 N aqueous sodium hydroxide solution was added over 5 minutes while applying ultrasonic vibration, and thereafter, reaction was performed for 20 minutes. Pure water at 5° C. was added to the slurry after the reaction and the solution was rapidly cooled to 30° C. or lower, and then a supernatant was removed. Furthermore, the slurry was washed with pure water, and the resulting cake was dried to obtain particles S-4.

Preparation Example of Particles S-5

A 1.0-fold molar amount of an aqueous strontium chloride solution was added to 2.6 mol (in terms of titanium oxide) of the titania sol dispersion, the mixture was placed in a reaction vessel, and nitrogen gas replacement was performed. Furthermore, pure water was added so that a titanium oxide concentration was 1.3 mol/L.

Next, after mixing with stirring and heating to 95° C., 300 mL of a 15 N sodium hydroxide solution was added over 5 minutes while applying ultrasonic vibration, and thereafter, reaction was performed for 20 minutes. Pure water at 5° C. was added to the slurry after the reaction and the solution was rapidly cooled to 30° C. or lower, and then a supernatant was removed.

Furthermore, an aqueous hydrochloric acid solution at pH 5.0 was added to the slurry and stirred for 1 hour, and the solution was washed with pure water repeatedly. Furthermore, the solution was neutralized with sodium hydroxide, filtered with a Nutsche filter, and washed with pure water. The resulting cake was dried to obtain particles S-5.

<Measurement of Average Particle Diameter of Primary Particles>

The average primary particle diameter (number average primary particle diameter) of the produced particles S-1 to S-5 was observed with a transmission electron microscope (trade name: H-800, manufactured by Hitachi, Ltd.), and a long diameter of 100 primary particles was measured in the field of view expanded up to 2 million times, thereby determining the average particle diameter of the primary particles. The results are shown in Table 1.

Further, a BET specific surface area value is also shown in Table 1.

TABLE 1

| Strontium titanate particles | Number average primary particle diameter (nm) | BET specific surface area ($m^3/g$) |
|---|---|---|
| S-1 | 35 | 60 |
| S-2 | 60 | 46 |
| S-3 | 100 | 30 |
| S-4 | 110 | 25 |
| S-5 | 10 | 90 |

Preparation Example of Surface-Treated Strontium Titanate Particles

Preparation Example of Surface-Treated Particles S-1A 100 parts of the particles S-1 was stirred and mixed with 500 parts of toluene, 2 parts of N-2-(aminoethyl)-3-aminopropylmethyldimethoxysilane (trade name: KBM602, manufactured by Shin-Etsu Chemical Co., Ltd.) was added thereto as a silane coupling agent, and the mixture was stirred for 6 hours. Thereafter, toluene was distilled off under reduced pressure, and the mixture was dried and heated at 130° C. for 6 hours to obtain surface-treated particles S-1A. A density of the particles S-1A was 5.13 g/cm$^3$ and a refractive index thereof was 2.40.

Preparation Example of Surface-Treated Particles S-2A to S-5A

In the preparation example of surface-treated particles S-1A, the particles S-1 were changed to the particles S-2 to S-5. Other than that, the surface-treated particles S-2A to S-5A were produced in the same manner as in the preparation example of the particle S-1A. Refractive indexes of the particles S-2A to S-5A were all 2.40.

Preparation Example of Surface-Treated Anatase Type Titanium Oxide Particles A-1

100 parts of anatase titanium oxide (number average primary particle diameter: 50 nm, trade name: TAF500, manufactured by FUJI TITANIUM INDUSTRY CO., LTD.) was stirred and mixed with 500 parts of toluene. 2 parts of N-2-(aminoethyl)-3-aminopropylmethyldimethoxysilane (trade name: KBM602, manufactured by Shin-Etsu Chemical Co., Ltd.) was added thereto as a silane coupling agent, and the mixture was stirred for 6 hours. Thereafter, toluene was distilled off under reduced pressure, and the mixture was dried and heated at 130° C. for 6 hours to obtain surface-treated particles A-1. A density of the particles A-1 was 3.9 g/cm$^3$ and a refractive index thereof was 2.52.

Preparation Example of Surface-Treated Rutile Type Titanium Oxide Particles R-1

100 parts of rutile type titanium oxide (number average primary particle diameter: 70 nm, trade name: PT401-M, manufactured by ISHIHARA SANGYO KAISHA, LTD.) was stirred and mixed with 500 parts of toluene. 2 parts of N-2-(aminoethyl)-3-aminopropylmethyldimethoxysilane (trade name: KBM602, manufactured by Shin-Etsu Chemical Co., Ltd.) was added thereto as a silane coupling agent, and the mixture was stirred for 6 hours. Thereafter, toluene was distilled off under reduced pressure, and the mixture was dried and heated at 130° C. for 6 hours to obtain surface-treated particles R-1. A density of the particles R-1 was 4.27 g/cm$^3$ and a refractive index thereof was 2.72.

Preparation Example of Surface-Treated Zirconium Dioxide Particles Z-1

100 parts of zirconium dioxide (number average primary particle diameter of 13 nm, trade name: Zirconium Oxide ($ZrO_2$), manufactured by ARBROWN Co., Ltd.) was stirred and mixed with 500 parts of toluene. 2 parts of N-2-(aminoethyl)-3-aminopropylmethyldimethoxysilane (trade name: KBM602, manufactured by Shin-Etsu Chemical Co., Ltd.) was added thereto as a silane coupling agent, and the mixture was stirred for 6 hours. Thereafter, toluene was distilled off under reduced pressure, and the mixture was dried and heated at 130° C. for 6 hours to obtain surface-treated particles Z-1. A density of the particles Z-1 was 5.68 g/cm$^3$ and a refractive index thereof was 2.13.

Preparation Example of Surface-Treated Zinc Oxide Particles Zn-1

100 parts of zinc oxide (number average primary particle diameter: 35 nm, trade name: MZ-300, manufactured by Tayca Corporation) was stirred and mixed with 500 parts of toluene. 2 parts of N-2-(aminoethyl)-3-aminopropylmethyldimethoxysilane (trade name: KBM602, manufactured by Shin-Etsu Chemical Co., Ltd.) was added thereto as a silane coupling agent, and the mixture was stirred for 6 hours. Thereafter, toluene was distilled off under reduced pressure, and the mixture was dried and heated at 130° C. for 6 hours to obtain surface-treated particles Zn-1. A refractive index of the particles Zn-1 was 2.00.

Example 1

As a support (electroconductive support), an aluminum cylinder having a length of 357.5 mm, a thickness of 0.7 mm, and an outer diameter of 30 mm was prepared. Cutting of a surface of the prepared aluminum cylinder was performed using a lathe.

As the cutting conditions, R0.1 bytes were used at a spindle speed=10000 rpm and a bite feed speed was continuously changed in a range of 0.03 to 0.06 mm/rpm to perform processing.

Hereinafter, the following binder resin materials were prepared.

15 parts of a butyral resin (trade name: BM-1, manufactured by SEKISUI CHEMICAL CO., LTD.) as a polyol resin 15 parts of block isocyanate (trade name: Sumidur 3175, manufactured by Sumika Bayer Urethane Co., Ltd.)

These were dissolved in a mixed solution of 300 parts of methyl ethyl ketone and 300 parts of 1-butanol. To this solution, 90 parts of the particles S-1A as strontium titanate particles were added, and this was dispersed in a sand mill apparatus using glass beads having a diameter of 0.8 mm under an atmosphere of 23±3° C. for 3 hours.

After dispersion, 0.01 parts of silicone oil (trade name: SH28PA, manufactured by Dow Corning Toray Co., Ltd.) as a leveling agent was added to the dispersion and stirred to obtain a coating solution for an undercoat layer.

The resulting coating solution for an undercoat layer was applied on the support by dip coating and dried at 160° C. for 30 minutes, thereby forming the undercoat layer having a film thickness of 2.0 μm.

A refractive index of the binder resin was 1.53, and a value of (a)−(b) in the above Formula (1) was 0.87.

A surface roughness of the undercoat layer manufactured as such was measured with a surface roughness measuring machine (trade name: SE-700, manufactured by Kosaka Laboratory Ltd.) under measuring conditions of a measuring length of 2.5 mm, a feeding speed of 0.1 mm/sec, and a cutoff value λc of 0.8 mm. The measurement points were 20 points which were 5 points in a longitudinal direction of the electrophotographic photosensitive member of 30 mm, 110 mm, 185 mm, 260 mm, and 340 mm from a coating upper end×4 points of 0°, 90°, 180°, and 270° as a measurement starting point in a circumferential direction. An average value of measured values at 20 points was used as an arithmetic average roughness Ra value. Ra value was 0.08 μm.

Hereinafter, the following materials were prepared.

20 parts of hydroxygallium phthalocyanine crystal (charge generating substance) of a crystal form having strong peaks at 7.4° and 28.2° with a Bragg angle of 2θ±0.2° in CuKα characteristic X-ray diffraction 0.2 parts of a calixarene compound represented by the following Formula (A)

10 parts of a polyvinyl butyral resin (trade name: S-LEC BX-1, manufactured by SEKISUI CHEMICAL CO., LTD.)

600 parts of cyclohexanone These were placed in a sand mill using glass beads having a diameter of 1 mm and dispersed for 4 hours, and 600 parts of ethyl acetate was added to prepare a coating solution for a charge generation layer.

The coating solution for a charge generation layer was applied on the undercoat layer by dip coating and the resulting coating film was dried at 80° C. for 15 minutes, thereby forming the charge generation layer having a film thickness of 0.19 μm.

(A)

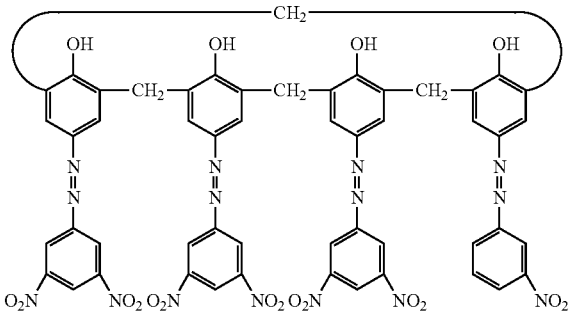

Hereinafter, the following materials were prepared.

70 parts of a compound (charge transporting substance) represented by the following Formula (B)

100 parts of a polycarbonate resin (trade name: Iupilon Z400, manufactured by Mitsubishi Engineering-Plastics Corporation, bisphenol Z type polycarbonate) as a binder resin 14.8 parts of tetrafluoroethylene particles (trade name: L-2, manufactured by DAIKIN INDUSTRIES, LTD.; average particle diameter of 190 nm) as fluororesin particles 1.2 parts of fluorine-containing dispersing agent having a structural unit represented by the following Formula (a−1) and a structural unit represented by the following Formula (b−1) (copolymerization ratio (a−1)/(b−1)=1/1 (molar ratio)) was dissolved in a mixed solvent of 600 parts of o-xylene and 200 parts of dimethoxymethane to prepare a coating solution for a charge transport layer.

In addition, the fluorine-containing dispersing agent was synthesized by referring to Japanese Patent Application Laid-Open No. 2009-104145.

The coating solution for a charge transport layer was applied on the charge generation layer by dip coating to form a coating film, and the resulting coating film was dried at 100° C. for 30 minutes, thereby forming the charge transport layer (surface layer) having a film thickness of 18 μm.

A refractive index of the binder resin was 1.59, a refractive index of the fluororesin particles was 1.35, and a value of (c)−(d) in the above Formula (2) was 0.24.

(B)

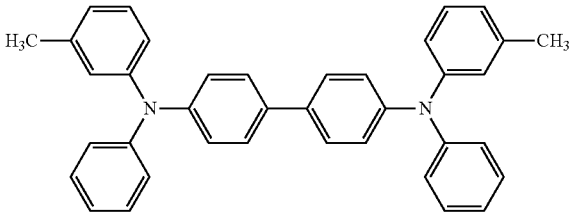

(a-1)

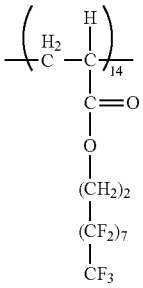

(b-1)

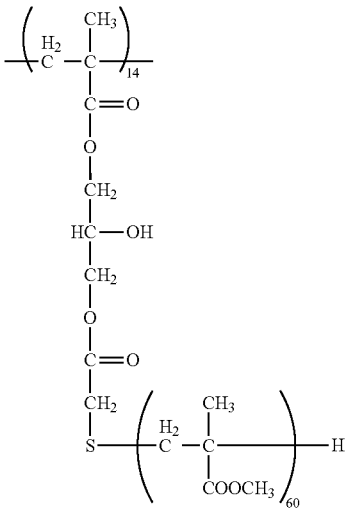

In the electrophotographic photosensitive member manufactured as described above, a ratio e % of the cross-sectional area of the metal oxide particles contained in the undercoat layer and a ratio f % of the cross-sectional area of the fluororesin particles contained in the charge transport layer were measured as follows.

First, a center part in an axial direction of the electrophotographic photosensitive member was cut into a round piece. From the cut portion, a 1 cm cross section in four directions was cut out, the cross section in four directions was smoothed, and then was mounted on SEM, and a cross-sectional view as illustrated in FIG. 2 was obtained.

Figure 2:
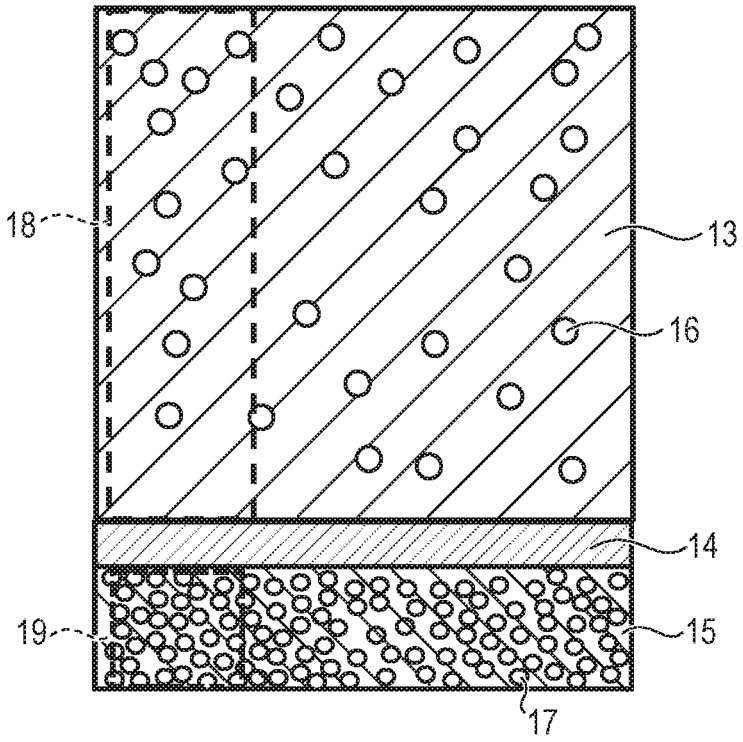
FIG. 2 is a drawing illustrating an example of determining a ratio e % of a cross-sectional area of metal oxide particles contained in an undercoat layer to a cross-sectional area of the undercoat layer and a ratio f % of a cross-sectional area of fluororesin particles contained in a surface layer to a cross-sectional area of the surface layer, in an any region of a cut surface obtained by cutting the electrophotographic photosensitive member according to the embodiment of the present invention vertically from the surface layer toward the undercoat layer.

FIG. 2 illustrates the cross-sectional view of the manufactured electrophotographic photosensitive member. The undercoat layer 15, the charge generation layer 14, and the charge transport layer 13 were laminated on the support (not illustrated) in this order. The fluororesin particles 16 were dispersed in the charge transport layer 13 and the metal oxide particles 17 were dispersed in the undercoat layer 15.

In the undercoat layer 15 of FIG. 2, an area 19 covering the entire undercoat layer in a film thickness direction was specified, and a binarization software was used to determine the ratio e % of the cross-sectional area of the metal oxide particles contained in the undercoat layer.

Next, in the charge transport layer 13 of FIG. 2, an area 18 covering the entire charge transport layer in a film thickness direction was specified, and then a binarization software was used to determine the ratio f % of the cross-sectional area of the fluororesin particles contained in the charge transport layer, and the value of e/f of the above Equation (3) was obtained. The value of e/f was 10.

Examples 2 to 6

In Example 1, the kind and amount of the binder resin and the kind and amount of the metal oxide used at the time of forming the undercoat layer were changed as shown in Table 2. Other than that, the electrophotographic photosensitive members according to Examples 2 to 6 were manufactured in the same manner as in Example 1.

TABLE 2

| | Binder resin of undercoat layer | Amount of used binder resin of undercoat layer (part) | Metal oxide particles | Amount of used metal oxide particles (part) |
|---|---|---|---|---|
| Example 1 | Urethane resin | 30 | Particles S-1A | 90 |
| Example 2 | Polyamide resin | 30 | Particles S-1A | 90 |
| Example 3 | Melamine resin-alkyd resin | 12/18 | Particles S-1A | 90 |
| Example 4 | Urethane resin | 30 | Particles A-1 | 84 |
| Example 5 | Polyamide resin | 30 | Particles A-1 | 84 |
| Example 6 | Melamine resin-alkyd resin | 12/18 | Particles A-1 | 84 |

In addition, the binder resin used in Examples 2 and 5 was a polyamide resin (trade name: CM8000, manufactured by TORAY INDUSTRIES, INC.), and the coating film was dried at 100° C. The refractive index of the polyamide resin used was 1.53.

Further, the binder resin used in Examples 3 and 6 was a melamine resin (trade name: BECKOSOL 1307-60-E, manufactured by DIC CORPORATION) and an alkyd resin (SUPER BECKAMINE G-821-60, manufactured by DIC CORPORATION). The refractive index of the melamine-alkyd resin used was 1.57.

Examples 7 to 10, 37 to 40, 43 to 46, and 55

In Example 1, the kind and amount of the metal oxide used at the time of forming the undercoat layer were changed as shown in Table 3. Other than that, the electrophotographic photosensitive members according to Examples 7 to 10, 37 to 40, 43 to 46, and 55 were manufactured in the same manner as in Example 1.

TABLE 3

| | Metal oxide particles | Amount of used metal oxide particles (part) |
|---|---|---|
| Example 7 | Particles A-1/particles R-1 | 63.0/3.0 |
| Example 8 | Particles S-1A/particles Z-1 | 58.8/31.2 |
| Example 9 | Particles S-1A/particles Z-1 | 38.9/51.1 |
| Example 10 | Particles S-1A/particles Z-1 | 34.6/55.4 |
| Example 37 | Particles S-5A | 135 |
| Example 38 | Particles S-2A | 45 |
| Example 39 | Particles S-3A | 30 |
| Example 40 | Particles S-4A | 30 |
| Example 43 | Particles S-1A | 18 |
| Example 44 | Particles S-1A | 30 |
| Example 45 | Particles S-1A | 150 |
| Example 46 | Particles S-1A | 180 |
| Example 55 | Particles S-1A | 135 |

Examples 11 to 20

In Examples 1 to 10, the binder resin used at the time of forming the charge transport layer was changed to a polyarylate resin having a structural unit represented by the following Formula (C). Other than that, the electrophotographic photosensitive members according to Examples 11 to 20 were manufactured in the same manner as in Examples 1 to 10.

In addition, the weight average molecular weight Mw of the polyarylate resin having the structural unit represented by the following Formula (C) was 120,000, the molar ratio of the terephthalic acid structure to the isophthalic acid structure (terephthalic acid skeleton:isophthalic acid skeleton) was 5/5, and the refractive index was 1.61.

(C)

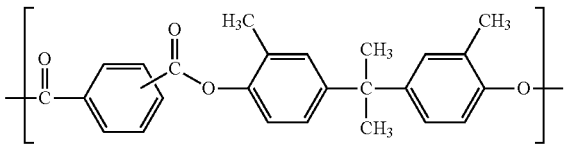

Examples 21 to 28

In Examples 1, 3, 4, and 6 to 10, the fluororesin particles were changed to the following materials.

7.5 parts of tetrafluoroethylene particles (trade name: L-2, manufactured by DAIKIN INDUSTRIES, LTD.; number average primary particle diameter of 190 nm, density of 2.2 g/cm$^3$, and refractive index of 1.35)

6.9 parts of polyvinylidene fluoride particles (trade name: Toreparu PVDF, manufactured by TORAY INDUSTRIES, INC., number average primary particle diameter of 200 nm, density of 1.78 g/cm$^3$, and refractive index of 1.42)

Other than that, the electrophotographic photosensitive members according to Examples 21 to 28 were manufactured in the same manner as in Examples 1, 3, 4, and 6 to 10.

Examples 29 to 36

In Examples 1, 3, 4, and 6 to 10, the fluororesin particles were changed to the following materials.

5.1 parts of tetrafluoroethylene particles (trade name: L-2, manufactured by DAIKIN INDUSTRIES, LTD.; number average primary particle diameter of 190 nm, density of 2.2 g/cm$^3$, and refractive index of 1.35)

9.2 parts of polyvinylidene fluoride particles (trade name: Toreparu PVDF, manufactured by TORAY INDUSTRIES, INC., number average primary particle diameter of 200 nm, density of 1.78 g/cm$^3$, and refractive index of 1.42)

Other than that, the electrophotographic photosensitive members according to Examples 29 to 36 were manufactured in the same manner as in Examples 1, 3, 4, and 6 to 10.

Examples 41 and 42

In Example 1, the amount of strontium titanate particles and particles S-1A used at the time of forming the undercoat layer was changed to 60 parts. Further, styrene/acryl particles (trade name: Fine Sphere MG451, manufactured by Nipponpaint Industrial Coatings Co., LTD., number average primary particle diameter of 100 nm) were added to the coating solution for an undercoat layer at 5 parts in Example 41 and at 10 parts in Example 42. The styrene/acryl particles were added for the purpose of roughening the surface of the undercoat layer. Other than that, the electrophotographic photosensitive members according to Examples 41 and 42 were manufactured in the same manner as in Example 1.

Example 47

In Example 1, the binder resin used at the time of forming the charge transport layer was changed to a polycarbonate copolymer having a structural unit represented by the following Formula (D). Other than that, the electrophotographic photosensitive member according to Example 47 was manufactured in the same manner as in Example 1.

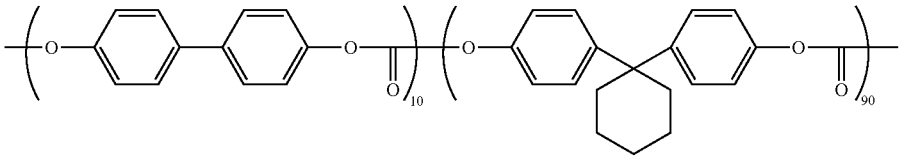

(D)

Examples 48 to 54

In Example 1, the amounts of the metal oxide particles, the fluororesin particles, and the fluorine-containing dispersing agent used were changed as shown in Table 4. Other than that, the electrophotographic photosensitive members according to Examples 48 to 54 were manufactured in the same manner as in Example 1.

TABLE 4

| | Amount of used metal oxide particles (part) | Amount of used fluororesin particles (part) | Amount of used fluorine containing dispersing agent (part) |
|---|---|---|---|
| Example 48 | 90 | 3.5 | 0.3 |
| Example 49 | 60 | 5.3 | 0.4 |
| Example 50 | 105 | 23.2 | 1.9 |
| Example 51 | 105 | 42.5 | 3.4 |
| Example 52 | 105 | 47.9 | 3.84 |
| Example 53 | 45 | 8.9 | 0.7 |
| Example 54 | 30 | 42.5 | 3.4 |

Comparative Examples 1 to 4

In Examples 7, 17, 25, and 33, the metal oxide particles were changed to 24.8 parts of anatase type titanium oxide (particles A-1) and 2.9 parts of rutile type titanium oxide particles (particles R-1). Other than that, the electrophotographic photosensitive members according to Comparative Examples 1 to 4 were manufactured in the same manner as in Examples 7, 17, 25, and 33.

Comparative Examples 5 to 8

In Examples 10, 20, and 28, the metal oxide particles were changed to 10 parts of strontium titanate particles S-1A and 20 parts of zirconium dioxide particles (particles Z-1). Other than that, the electrophotographic photosensitive members according to Comparative Examples 5 to 8 were manufactured in the same manner as in Example 1.

Comparative Examples 9 to 16

In Comparative Example 4, Examples 4, 6, 1, 3, 8, and 9, and Comparative Example 5, the fluororesin particles were changed to 14.1 parts of polyvinylidene fluoride particles (trade name: Toreparu PVDF, manufactured by TORAY INDUSTRIES, INC., number average primary particle diameter of 200 nm). Other than that, the electrophotographic photosensitive members according to Comparative Examples 9 to 16 were manufactured in the same manner as in Comparative Example 4, Examples 4, 6, 1, 3, 8, and 9, and Comparative Example 5.

Comparative Example 17

In Example 1, no fluororesin particles were used. Other than that, the electrophotographic photosensitive member according to Comparative Example 17 was manufactured in the same manner as in Example 1.

Comparative Example 18

In Example 41, 135 parts of metal oxide particles were used. Other than that, the electrophotographic photosensitive member according to Comparative Example 18 was manufactured in the same manner as in Example 41.

Comparative Example 19

In Example 41, the metal oxide particles were changed to zinc oxide particles (particles Zn-1). Other than that, the electrophotographic photosensitive member according to Comparative Example 19 was manufactured in the same manner as in Example 1.

Comparative Example 20

In Example 1, no metal oxide particles were used. Other than that, the electrophotographic photosensitive member according to Comparative Example 20 was manufactured in the same manner as in Example 1.

For the electrophotographic photosensitive member according to each of the above Examples and the Comparative Examples, each of the following values is shown in Tables 5 and 6: the number average primary particle diameter of the metal oxide particles, the content of the metal oxide particles relative to the binder resin in the undercoat layer, the content of the fluororesin particles in the charge transport layer, (a)−(b) in the above Equation (1), (c)−(d) in the above Equation (2), e/f in the above Equation (3), and the roughness Ra of the undercoat layer surface.

TABLE 5

| | Number average primary particle diameter of metal oxide particles (nm) | Content of metal oxide particles (% by mass) | Content of fluororesin particles (% by mass) | Equation (1) (a) − (b) | Equation (2) (c) − (d) | Equation (3) e/f | Roughness Ra of undercoat layer surface (μm) |
|---|---|---|---|---|---|---|---|
| Example 1 | 35 | 3 | 8.0 | 0.87 | 0.24 | 10 | 0.08 |
| Example 2 | 35 | 3 | 8.0 | 0.87 | 0.24 | 10 | 0.08 |
| Example 3 | 35 | 3 | 8.0 | 0.83 | 0.24 | 10 | 0.08 |
| Example 4 | 50 | 2.8 | 8.0 | 0.99 | 0.24 | 9 | 0.08 |

TABLE 5-continued

| | Number average primary particle diameter of metal oxide particles (nm) | Content of metal oxide particles (% by mass) | Content of fluororesin particles (% by mass) | Equation (1) (a) − (b) | Equation (2) (c) − (d) | Equation (3) e/f | Roughness Ra of undercoat layer surface (μm) |
|---|---|---|---|---|---|---|---|
| Example 5 | 50 | 2.8 | 8.0 | 0.99 | 0.24 | 9 | 0.08 |
| Example 6 | 50 | 2.8 | 8.0 | 0.95 | 0.24 | 9 | 0.08 |
| Example 7 | 50/70 | 2.2 | 8.0 | 1.00 | 0.24 | 7 | 0.08 |
| Example 8 | 35/15 | 3 | 8.0 | 0.77 | 0.24 | 12 | 0.08 |
| Example 9 | 35/15 | 3 | 8.0 | 0.71 | 0.24 | 12 | 0.08 |
| Example 10 | 35/15 | 3 | 8.0 | 0.70 | 0.24 | 12 | 0.08 |
| Example 11 | 35 | 3 | 8.0 | 0.87 | 0.26 | 10 | 0.08 |
| Example 12 | 35 | 3 | 8.0 | 0.87 | 0.26 | 10 | 0.08 |
| Example 13 | 35 | 3 | 8.0 | 0.83 | 0.26 | 10 | 0.08 |
| Example 14 | 50 | 2.8 | 8.0 | 0.99 | 0.26 | 9 | 0.08 |
| Example 15 | 50 | 2.8 | 8.0 | 0.99 | 0.26 | 9 | 0.08 |
| Example 16 | 50 | 2.8 | 8.0 | 0.95 | 0.26 | 9 | 0.08 |
| Example 17 | 50/70 | 2.2 | 8.0 | 1.00 | 0.26 | 7 | 0.08 |
| Example 18 | 35/15 | 3 | 8.0 | 0.77 | 0.26 | 12 | 0.08 |
| Example 19 | 35/15 | 3 | 8.0 | 0.71 | 0.26 | 12 | 0.08 |
| Example 20 | 35/15 | 3 | 8.0 | 0.70 | 0.26 | 12 | 0.08 |
| Example 21 | 35 | 3 | 7.8 | 0.87 | 0.21 | 10 | 0.08 |
| Example 22 | 35 | 3 | 7.8 | 0.83 | 0.21 | 10 | 0.08 |
| Example 23 | 50 | 2.8 | 7.8 | 0.99 | 0.21 | 9 | 0.08 |
| Example 24 | 50 | 2.8 | 7.8 | 0.95 | 0.21 | 9 | 0.08 |
| Example 25 | 50/70 | 2.2 | 7.8 | 1.00 | 0.21 | 7 | 0.08 |
| Example 26 | 35/15 | 3 | 7.8 | 0.77 | 0.21 | 12 | 0.08 |
| Example 27 | 35/15 | 3 | 7.8 | 0.71 | 0.21 | 12 | 0.08 |
| Example 28 | 35/15 | 3 | 7.8 | 0.70 | 0.21 | 12 | 0.08 |
| Example 29 | 35 | 3 | 7.7 | 0.87 | 0.20 | 10 | 0.08 |
| Example 30 | 35 | 3 | 7.7 | 0.83 | 0.20 | 10 | 0.08 |
| Example 31 | 50 | 2.8 | 7.7 | 0.99 | 0.20 | 9 | 0.08 |
| Example 32 | 50 | 2.8 | 7.7 | 0.95 | 0.20 | 9 | 0.08 |
| Example 33 | 50/70 | 2.2 | 7.7 | 1.00 | 0.20 | 7 | 0.08 |
| Example 34 | 35/15 | 3 | 7.7 | 0.77 | 0.20 | 12 | 0.08 |
| Example 35 | 35/15 | 3 | 7.7 | 0.71 | 0.20 | 12 | 0.08 |
| Example 36 | 35/15 | 3 | 7.7 | 0.70 | 0.20 | 12 | 0.08 |
| Example 37 | 10 | 4.5 | 8.0 | 0.87 | 0.24 | 9 | 0.06 |
| Example 38 | 60 | 1.5 | 8.0 | 0.87 | 0.24 | 8 | 0.10 |
| Example 39 | 100 | 1 | 8.0 | 0.87 | 0.24 | 6 | 0.13 |
| Example 40 | 110 | 1 | 8.0 | 0.87 | 0.24 | 5 | 0.15 |
| Example 41 | 35 | 2 | 8.0 | 0.87 | 0.24 | 8 | 0.11 |
| Example 42 | 35 | 2 | 8.0 | 0.87 | 0.24 | 8 | 0.14 |
| Example 43 | 35 | 0.6 | 8.0 | 0.87 | 0.24 | 4 | 0.04 |
| Example 44 | 35 | 1 | 8.0 | 0.87 | 0.24 | 6 | 0.05 |
| Example 45 | 35 | 5 | 8.0 | 0.87 | 0.24 | 14 | 0.13 |
| Example 46 | 35 | 6 | 8.0 | 0.87 | 0.24 | 16 | 0.15 |
| Example 47 | 35 | 3 | 8.0 | 0.87 | 0.24 | 10 | 0.08 |
| Example 48 | 35 | 3 | 2.0 | 0.87 | 0.24 | 15 | 0.08 |
| Example 49 | 35 | 2 | 3.0 | 0.87 | 0.24 | 12 | 0.07 |
| Example 50 | 35 | 3.5 | 11.9 | 0.87 | 0.24 | 8 | 0.08 |
| Example 51 | 35 | 4 | 19.9 | 0.87 | 0.24 | 7 | 0.09 |
| Example 52 | 35 | 4 | 21.9 | 0.87 | 0.24 | 6 | 0.09 |
| Example 53 | 35 | 1.5 | 19.9 | 0.87 | 0.24 | 3 | 0.07 |
| Example 54 | 35 | 1 | 44.1 | 0.87 | 0.24 | 5 | 0.06 |
| Example 55 | 35 | 4.5 | 8.0 | 0.87 | 0.24 | 10 | 0.13 |

TABLE 6

| | Number average primary particle diameter of metal oxide particles (nm) | Content of metal oxide particles (% by mass) | Content of fluororesin particles (% by mass) | Equation (1) (a) − (b) | Equation (2) (c) − (d) | Equation (3) e/f | Roughness Ra of undercoat layer surface (μm) |
|---|---|---|---|---|---|---|---|
| Comparative Example 1 | 50/70 | 2.2 | 8.0 | 1.01 | 0.24 | 10 | 0.08 |
| Comparative Example 2 | 50/70 | 2.2 | 8.0 | 1.01 | 0.26 | 10 | 0.08 |
| Comparative Example 3 | 50/70 | 2.2 | 8.0 | 1.01 | 0.21 | 10 | 0.08 |
| Comparative Example 4 | 50/70 | 2.2 | 8.0 | 1.01 | 0.20 | 10 | 0.08 |

TABLE 6-continued

| | Number average primary particle diameter of metal oxide particles (nm) | Content of metal oxide particles (% by mass) | Content of fluororesin particles (% by mass) | Equation (1) (a) − (b) | Equation (2) (c) − (d) | Equation (3) e/f | Roughness Ra of undercoat layer surface (μm) |
|---|---|---|---|---|---|---|---|
| Comparative Example 5 | 35/15 | 3 | 8.0 | 0.69 | 0.24 | 10 | 0.08 |
| Comparative Example 6 | 35/15 | 3 | 8.0 | 0.69 | 0.26 | 10 | 0.08 |
| Comparative Example 7 | 35/15 | 3 | 8.0 | 0.69 | 0.21 | 10 | 0.08 |
| Comparative Example 8 | 35/15 | 3 | 8.0 | 0.69 | 0.20 | 10 | 0.08 |
| Comparative Example 9 | 50/70 | 2.2 | 7.6 | 1.01 | 0.19 | 10 | 0.08 |
| Comparative Example 10 | 50 | 2.8 | 7.6 | 0.99 | 0.19 | 10 | 0.08 |
| Comparative Example 11 | 50 | 2.8 | 7.6 | 0.95 | 0.19 | 10 | 0.08 |
| Comparative Example 12 | 35 | 3 | 7.6 | 0.87 | 0.19 | 10 | 0.08 |
| Comparative Example 13 | 35 | 3 | 7.6 | 0.83 | 0.19 | 10 | 0.08 |
| Comparative Example 14 | 35/15 | 3 | 7.6 | 0.77 | 0.19 | 10 | 0.08 |
| Comparative Example 15 | 35/15 | 3 | 7.6 | 0.71 | 0.19 | 10 | 0.08 |
| Comparative Example 16 | 35/15 | 3 | 7.6 | 0.69 | 0.19 | 10 | 0.08 |
| Comparative Example 17 | 35 | 3 | 0.0 | 0.87 | 1.59 | 10 | 0.08 |
| Comparative Example 18 | 35 | 4.5 | 8.0 | 0.87 | 0.24 | 14 | 0.20 |
| Comparative Example 19 | 35 | 3 | 8.0 | 0.47 | 0.24 | 10 | 0.08 |
| Comparative Example 20 | — | — | 8.0 | — | 0.24 | — | 0.003 |

[Evaluation]

The electrophotographic photosensitive member according to each of the above Examples and Comparative Examples was mounted on a black toner station of a copier (trade name: imageRUNNER ADVANCE C556011, manufactured by Canon Inc.) used as the electrophotographic apparatus for evaluation to perform each evaluation.

The reproducibility of the halftone image density of a highlight was evaluated as follows.

Image charts having image densities of 0.05, 0.07, 0.10, 0.12, 0.15, and 0.20 were manufactured, images were outputted, and the images were ranked as follows.

A: Images were obtained at any image density.

B: A portion at 0.05 was slightly thinner, but images at other densities were obtained.

C: The image at a density of 0.05 was not outputted, but the images at other densities were obtained, and there was no practical problem. D: A portion at 0.07 was slightly thinner, but images at other densities were obtained.

E: The image at a density of 0.07 was not outputted, but the images at other densities were obtained.

The results are shown in Tables 7 and 8.

For the fine line reproducibility, one-line images of 600 dpi and 1200 dpi were outputted and the images were ranked as follows for evaluation.

A: Lines were drawn also at 600 dpi and 1200 dpi.

B: The line of 1200 dpi was slightly thinner and the line of 600 dpi was drawn.

C: The line of 1200 dpi was extremely partially broken and the line of 600 dpi was drawn, and there was no practical problem.

D: The line of 1200 dpi was broken and the line of 600 dpi was drawn a little thin.

E: The line of 600 dpi was broken.

The results are shown in Tables 7 and 8.

For the generation of interference fringe images, halftone images of an image density of 0.3 were outputted, and the images were ranked for evaluation as follows.

A: No interference fringe was confirmed.

B: The interference fringe image was very slightly confirmed at an image density of 0.2, but there was no practical problem.

C: The interference fringe image was confirmed.

The results are shown in Tables 7 and 8.

The abrasion resistance of the electrophotographic photosensitive member was evaluated as follows.

The film thickness of the charge transport layer of the electrophotographic photosensitive member according to each of the above Examples and Comparative Examples was previously measured.

Each electrophotographic photosensitive member was mounted on a copier (trade name: imageRUNNER ADVANCE C556011, manufactured by Canon Inc.). Thereafter, image charts having an A4 size and a density of 10% were used to continuously output images on 200,000 sheets, under an environment of 23° C. and 50% RH. The film thickness of the charge transport layer after image output was measured, and the amount of abrasion was calculated from a difference from the thickness before image output. The results are shown in Tables 7 and 8.

TABLE 7

| | Density reproducibility | Fine line reproducibility | Interference fringe | Abrasion amount (μm) |
|---|---|---|---|---|
| Example 1 | A | A | A | 3.5 |
| Example 2 | A | A | A | 3.5 |
| Example 3 | A | A | A | 3.5 |
| Example 4 | A | A | A | 3.5 |
| Example 5 | A | A | A | 3.5 |
| Example 6 | A | A | A | 3.5 |
| Example 7 | A | B | A | 3.5 |
| Example 8 | A | A | A | 3.5 |
| Example 9 | A | A | A | 3.5 |
| Example 10 | A | B | A | 3.5 |
| Example 11 | A | A | A | 3.5 |
| Example 12 | A | A | A | 3.5 |
| Example 13 | A | A | A | 3.5 |
| Example 14 | A | A | A | 3.5 |
| Example 15 | A | A | A | 3.5 |
| Example 16 | A | A | A | 3.5 |
| Example 17 | A | B | A | 3.5 |
| Example 18 | A | A | A | 3.5 |
| Example 19 | A | A | A | 3.5 |
| Example 20 | A | B | A | 3.5 |
| Example 21 | A | A | A | 3.5 |
| Example 22 | A | A | A | 3.5 |
| Example 23 | A | A | A | 3.5 |
| Example 24 | A | A | A | 3.5 |
| Example 25 | A | A | A | 3.5 |
| Example 26 | A | A | A | 3.5 |
| Example 27 | A | A | A | 3.5 |
| Example 28 | A | B | A | 3.5 |
| Example 29 | A | A | A | 3.5 |
| Example 30 | A | A | A | 3.5 |
| Example 31 | A | A | A | 3.5 |
| Example 32 | A | A | A | 3.5 |
| Example 33 | A | B | A | 3.5 |
| Example 34 | A | A | A | 3.5 |
| Example 35 | A | A | A | 3.5 |
| Example 36 | A | B | A | 3.5 |
| Example 37 | A | A | A | 3.5 |
| Example 38 | A | A | A | 3.5 |
| Example 39 | A | A | A | 3.5 |
| Example 40 | A | C | A | 3.5 |
| Example 41 | A | A | A | 3.5 |
| Example 42 | A | A | A | 3.5 |
| Example 43 | B | C | B | 3.5 |
| Example 44 | A | A | A | 3.5 |
| Example 45 | A | A | A | 3.5 |
| Example 46 | A | C | A | 3.5 |
| Example 47 | A | A | A | 3.5 |
| Example 48 | A | C | A | 5 |
| Example 49 | A | A | A | 4.5 |
| Example 50 | A | A | A | 3 |
| Example 51 | A | A | A | 2.3 |
| Example 52 | C | A | A | 2 |
| Example 53 | B | C | B | 3.5 |
| Example 54 | A | A | A | 3.5 |
| Example 55 | A | A | A | 3.5 |

TABLE 8

| | Density reproducibility | Fine line reproducibility | Interference fringe | Abrasion amount (μm) |
|---|---|---|---|---|
| Comparative Example 1 | B | D | A | 3.5 |
| Comparative Example 2 | A | D | A | 3.5 |
| Comparative Example 3 | C | E | A | 3.5 |
| Comparative Example 4 | C | E | A | 3.5 |
| Comparative Example 5 | B | D | B | 3.5 |
| Comparative Example 6 | B | D | B | 3.5 |
| Comparative Example 7 | B | E | B | 3.5 |
| Comparative Example 8 | B | E | B | 3.5 |
| Comparative Example 9 | E | E | A | 3.5 |
| Comparative Example 10 | E | E | A | 3.5 |
| Comparative Example 11 | D | E | A | 3.5 |

TABLE 8-continued

| | Density reproducibility | Fine line reproducibility | Interference fringe | Abrasion amount (μm) |
|---|---|---|---|---|
| Comparative Example 12 | D | D | A | 3.5 |
| Comparative Example 13 | C | D | A | 3.5 |
| Comparative Example 14 | C | D | A | 3.5 |
| Comparative Example 15 | B | E | A | 3.5 |
| Comparative Example 16 | A | E | B | 3.5 |
| Comparative Example 17 | A | E | A | 6 |
| Comparative Example 18 | B | E | A | 3.5 |
| Comparative Example 19 | D | E | C | 3.5 |
| Comparative Example 20 | E | A | C | 3.5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-202047, filed on Oct. 26, 2018, which is hereby incorporated by reference herein in its entirety.

What is claimed is:

1. An electrophotographic photosensitive member, comprising:

an undercoat layer, a photosensitive layer and a surface layer on or above an electro-conductive support in this order;

the undercoat layer containing metal oxide particles and at least one binder resin selected from the group consisting of a urethane resin, a polyamide resin and a melamine-alkyd resin;

the surface layer containing a charge transporting substance, fluororesin particles, and at least one binder resin selected from the group consisting of a polycarbonate resin and a polyarylate resin, a surface of the undercoat layer having an arithmetic average roughness Ra of 0.15 μm or less, wherein $0.70 \leq (a)-(b) \leq 1.00$ and $0.20 \leq (c)-(d)$ where (a) is a refractive index of the metal oxide particles, (b) is a refractive index of the binder resin contained in the undercoat layer, (c) is a refractive index (c) of the binder resin contained in the surface layer and (d) is a refractive index of the fluororesin particles, and $5.0 \leq e/f \leq 15.0$ where in an any region including at least a part of each of the surface layer and the undercoat layer of a cut surface obtained by cutting the electrophotographic photosensitive member vertically from the surface layer toward the undercoat layer, when e (%) is a ratio of a cross-sectional area of the metal oxide particles contained in the undercoat layer to a cross-sectional area of the undercoat layer, and f (%) is a ratio of a cross-sectional area of the fluororesin particles contained in the surface layer to a cross-sectional area of the surface layer.

2. The electrophotographic photosensitive member according to claim 1, wherein a content of the metal oxide particles is 100 to 500% by mass relative to the binder resin contained in the undercoat layer.

3. The electrophotographic photosensitive member according to claim 1, wherein a content of the fluororesin particles is 3.0 to 20.0% by mass relative to a total mass of the surface layer.

4. The electrophotographic photosensitive member according to claim 1, wherein a number average primary particle diameter of the metal oxide particles is 10 to 100 nm.

5. The electrophotographic photosensitive member according to claim 1, wherein the metal oxide particles are strontium titanate or anatase type titanium oxide.

6. A process cartridge which integrally supports an electrophotographic photosensitive member and at least one unit selected from the group consisting of a charging unit, a developing unit, a transfer unit, and a cleaning unit, and is detachably attachable to a main body of an electrophotographic apparatus, the electrophotographic photosensitive member comprising an undercoat layer, a photosensitive layer and a surface layer on or above an electro-conductive support in this order;

the undercoat layer containing metal oxide particles and at least one binder resin selected from the group consisting of a urethane resin, a polyamide resin and a melamine-alkyd resin;

the surface layer containing a charge transporting substance, fluororesin particles, and at least one binder resin selected from the group consisting of a polycarbonate resin and a polyarylate resin, a surface of the undercoat layer having an arithmetic average roughness Ra of 0.15 μm or less, wherein $0.70 \leq (a)-(b) \leq 1.00$ and $0.20 \leq (c)-(d)$ where (a) is a refractive index of the metal oxide particles, (b) is a refractive index of the binder resin contained in the undercoat layer, (c) is a refractive index (c) of the binder resin contained in the surface layer and (d) is a refractive index of the fluororesin particles, and $5.0 \leq e/f \leq 15.0$ where in an any region including at least a part of each of the surface layer and the undercoat layer of a cut surface obtained by cutting the electrophotographic photosensitive member vertically from the surface layer toward the undercoat layer, when e (%) is a ratio of a cross-sectional area of the metal oxide particles contained in the undercoat layer to a cross-sectional area of the undercoat layer, and f (%) is a ratio of a cross-sectional area of the fluororesin particles contained in the surface layer to a cross-sectional area of the surface layer.

7. An electrophotographic apparatus comprising: an electrophotographic photosensitive member, a charging unit, an exposing unit, a developing unit, and a transfer unit, the electrophotographic photosensitive member comprising an undercoat layer, a photosensitive layer and a surface layer on or above an electro-conductive support in this order;

the undercoat layer containing metal oxide particles and at least one binder resin selected from the group consisting of a urethane resin, a polyamide resin and a melamine-alkyd resin;

the surface layer containing a charge transporting substance, fluororesin particles, and at least one binder resin selected from the group consisting of a polycarbonate resin and a polyarylate resin, a surface of the undercoat layer having an arithmetic average roughness Ra of 0.15 μm or less, wherein $0.70 \leq (a)-(b) \leq 1.00$ and $0.20 \leq (c)-(d)$ where (a) is a refractive index of the metal oxide particles, (b) is a refractive index of the binder resin contained in the undercoat layer, (c) is a refractive index (c) of the binder resin contained in the surface layer and (d) is a refractive index of the fluororesin particles, and $5.0 \leq e/f \leq 15.0$ where in an any region including at least a part of each of the surface layer and the undercoat layer of a cut surface obtained by cutting the electrophotographic photosensitive member vertically from the surface layer toward the undercoat layer, when e (%) is a ratio of a cross-sectional area of the metal oxide particles contained in the undercoat layer to a cross-sectional area of the undercoat layer, and f (%) is a ratio of a cross-sectional area of the fluororesin particles contained in the surface layer to a cross-sectional area of the surface layer.

* * * * *